US009669965B2

(12) United States Patent
Kalagher

(10) Patent No.: US 9,669,965 B2
(45) Date of Patent: Jun. 6, 2017

(54) CHEMICAL ADDITIVE PACKAGE

(71) Applicant: PRESTONE PRODUCTS CORPORATION, Lake Forest, IL (US)

(72) Inventor: Thomas G. Kalagher, Torrington, CT (US)

(73) Assignee: Prestone Products Corporation, Lake Forest, IL (US)

( * ) Notice: Subject to any disclaimer, the term of this patent is extended or adjusted under 35 U.S.C. 154(b) by 0 days.

(21) Appl. No.: 14/676,309

(22) Filed: Apr. 1, 2015

(65) Prior Publication Data

US 2015/0291312 A1 Oct. 15, 2015

Related U.S. Application Data

(60) Provisional application No. 61/979,897, filed on Apr. 15, 2014.

(51) Int. Cl.

| | |
|---|---|
| ***B65D 1/04*** | (2006.01) |
| ***B65D 25/04*** | (2006.01) |
| ***B65D 39/00*** | (2006.01) |
| ***B65D 81/32*** | (2006.01) |
| ***B65D 51/28*** | (2006.01) |

(52) U.S. Cl.

CPC ..... *B65D 25/04* (2013.01); *B65D 39/0052* (2013.01); *B65D 51/28* (2013.01); *B65D 81/3227* (2013.01)

(58) Field of Classification Search

CPC .... B65D 51/28; B65D 81/3216; B65D 51/18; B65D 81/3222; B01F 13/0022

See application file for complete search history.

(56) References Cited

U.S. PATENT DOCUMENTS

| | | | | |
|---|---|---|---|---|
| 1,967,349 | A * | 7/1934 | Carvalho | B65D 51/245 215/227 |
| 2,321,998 | A * | 6/1943 | Crouch | B65D 51/28 215/6 |
| D320,469 | S | 10/1991 | Hoenig | |
| D480,590 | S | 10/2003 | Linz | |
| D530,968 | S | 10/2006 | Bodum | |
| D539,164 | S | 3/2007 | Decottignies | |
| D611,823 | S | 3/2010 | Sindler | |
| D613,183 | S | 4/2010 | Overgaard | |
| D613,604 | S | 4/2010 | Rowland | |
| D621,283 | S | 8/2010 | Overgaard | |

(Continued)

FOREIGN PATENT DOCUMENTS

| | | |
|---|---|---|
| WO | 02055399 | 7/2002 |
| WO | 2006102472 | 9/2006 |
| WO | 2012082712 | 6/2012 |

OTHER PUBLICATIONS

International Search Report & Written Opinion of PCT/US2015/023864 dated Jun. 17, 2015.

(Continued)

*Primary Examiner* — Shawn M Braden

(74) *Attorney, Agent, or Firm* — Gregory H. Zayia; Barnes & Thornburg LLP

(57) ABSTRACT

An additive package for storing automotive treatment chemicals. Additive components can be combined and added to a vehicle cooling or other system to enhance or repair system performance in a motor vehicle, and stop and prevent leaks.

15 Claims, 7 Drawing Sheets

(56) References Cited

U.S. PATENT DOCUMENTS

| | | | | |
|---|---|---|---|---|
| D621,660 | S | 8/2010 | Smiedt | |
| D627,604 | S | 11/2010 | Eyal | |
| 7,896,181 | B1 | 3/2011 | Francis | |
| D636,275 | S | 4/2011 | Stapleton | |
| D639,661 | S | 6/2011 | Llerena | |
| D639,663 | S | 6/2011 | Llerena | |
| D671,787 | S | 12/2012 | Lin | |
| D684,805 | S | 6/2013 | Bjerre-Poulsen | |
| D690,161 | S | 9/2013 | Garner | |
| D698,244 | S | 1/2014 | Lin | |
| D701,727 | S | 4/2014 | Gilbert | |
| D703,052 | S | 4/2014 | Park | |
| D703,053 | S | 4/2014 | Park | |
| D715,156 | S | 10/2014 | Park | |
| D716,666 | S | 11/2014 | Park | |
| 9,114,910 | B1 | 8/2015 | Schommer | |
| D739,084 | S | 9/2015 | Hall | |
| D741,603 | S | 10/2015 | Mehta | |
| D747,619 | S | 1/2016 | Hampton | |
| D759,432 | S | 6/2016 | Harris | |
| D760,542 | S | 7/2016 | Vu | |
| D769,067 | S | 10/2016 | Cheung | |
| D777,575 | S | 1/2017 | Harada | |
| 2009/0178573 | A1 | 7/2009 | Pan | |
| 2009/0272747 | A1* | 11/2009 | Kalaouze, Jr. ..... | B65D 81/3222 220/500 |
| 2009/0294397 | A1* | 12/2009 | Wu ..... | B65D 81/3222 215/6 |

OTHER PUBLICATIONS

Notice of Allowance, U.S. Appl. No. 29/502,697 dated May 11, 2016.

* cited by examiner

CHEMICAL ADDITIVE PACKAGE

CROSS-REFERENCE TO RELATED APPLICATION

This application claims the benefit of and priority to U.S. Provisional Patent Application Ser. No. 61/979,897, filed Apr. 15, 2014, which is incorporated herein by this reference in its entirety.

BACKGROUND

The present disclosure relates to containers. More particularly, the present disclosure relates to bottles and storage containers for chemical additives that are used with automotive coolant and other systems.

SUMMARY

The present application discloses one or more of the features recited in the appended claims and/or the following features which, alone or in any combination, may comprise patentable subject matter.

In illustrative embodiments, a chemical additive package includes a bottle including a body defining an interior volume of the bottle and an opening extending into the interior volume of the bottle. The bottle is adapted to store a first additive. The package also includes a container arranged to extend into the interior volume of the bottle. The container includes a tube defining an interior volume of the container. The container also includes an opening extending into the tube and a hanger for coupling the container to the bottle to suspend the tube in the interior volume of the bottle. The container is adapted to store a second additive.

In illustrative embodiments, the chemical additive package includes a cap arranged to engage and be secured to the bottle to cover and seal the openings into the interior volumes of the bottle and container. The cap of the package includes a compartment for storing a third additive and a cover for closing an opening into an interior volume of the compartment. The interior volumes of the bottle, container, and compartment are in fluid isolation relative to one another when the bottle, container, and cap are coupled together.

These and other features of the present disclosure will become more apparent from the following description of the illustrative embodiments.

BRIEF DESCRIPTION OF THE DRAWINGS

The detailed description particularly refers to the accompanying figures in which.

DETAILED DESCRIPTION

Figure 1:
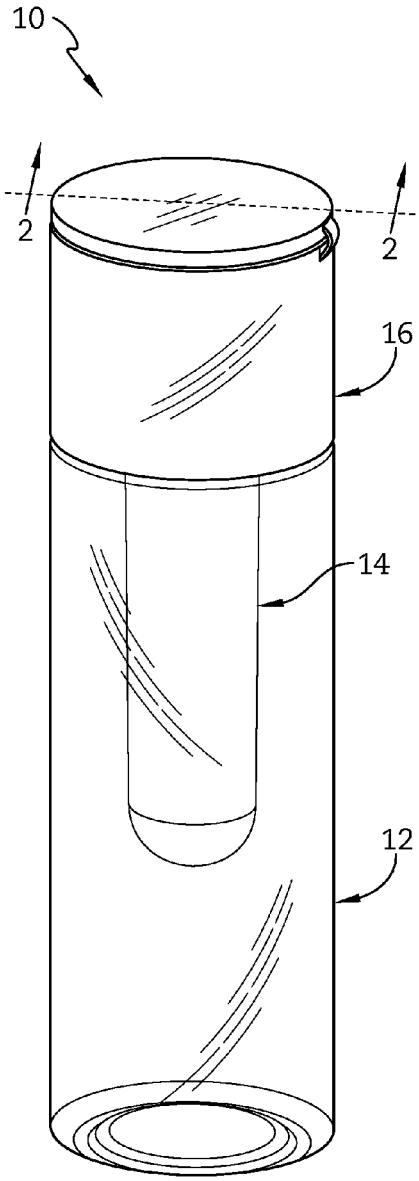
FIG. 1 is a perspective view of one embodiment of a chemical product additive package in accordance with the present disclosure showing the package includes a cylindrical bottle, a container coupled to the bottle to hang within an interior volume of the bottle, and a cap coupled to the bottle over the container.

For the purposes of promoting an understanding of the principles of the disclosure, reference will now be made to a number of illustrative embodiments illustrated in the drawings and specific language will be used to describe the same.

One embodiment of a chemical additive package 10 for storing cooling system treatment chemicals or other treatment chemicals, powders, or granules in accordance with the present disclosure is shown in FIG. 1. The package 10 includes a cylindrical bottle 12, a container 14 suspended within an interior volume of the bottle 12, and a cap 16 coupled to the bottle 12 over the container 14. As assembled, the package 10 safely stores chemicals, powders or granules prior to being added to a coolant or other system to enhance system performance in a motor vehicle, and to stop and prevent leaks.

Figure 2:
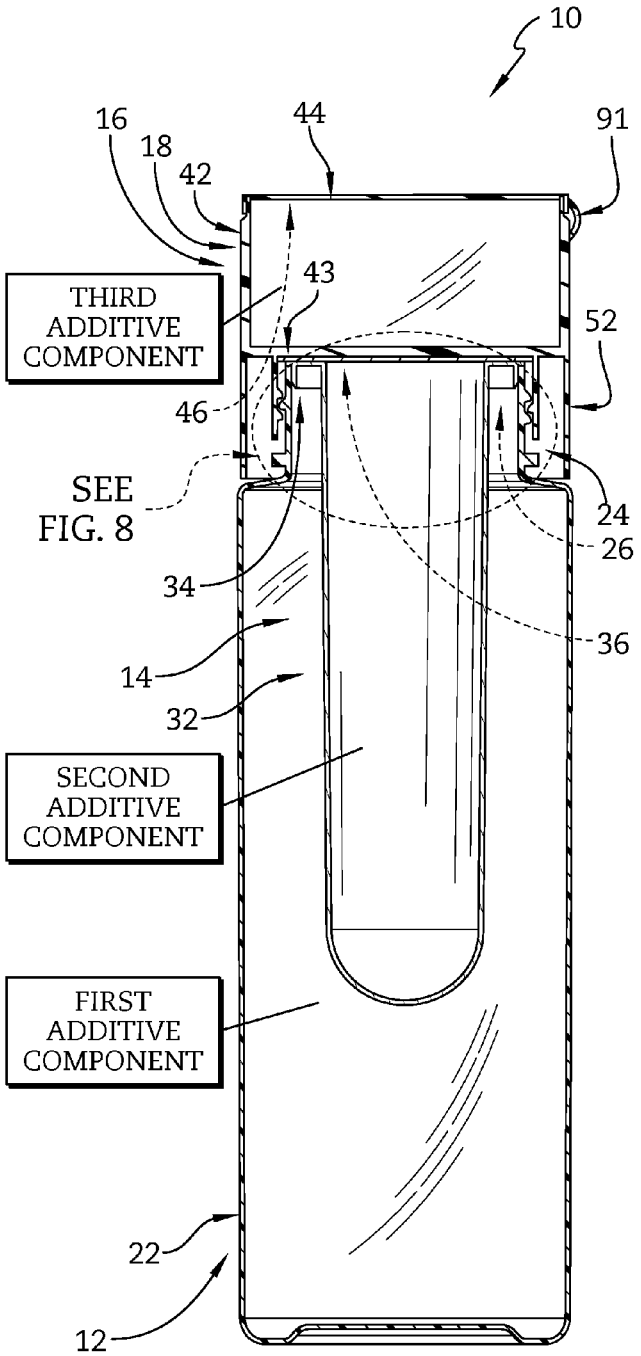
FIG. 2 is a cross-sectional view of the package of FIG. 1 suggesting that the bottle is arranged to hold a first additive component, the container is arranged to hold a second additive component separate from the first additive component, and the cap includes a compartment that is arranged to hold a third additive component separate from the first and second additive components.
Figure 3:
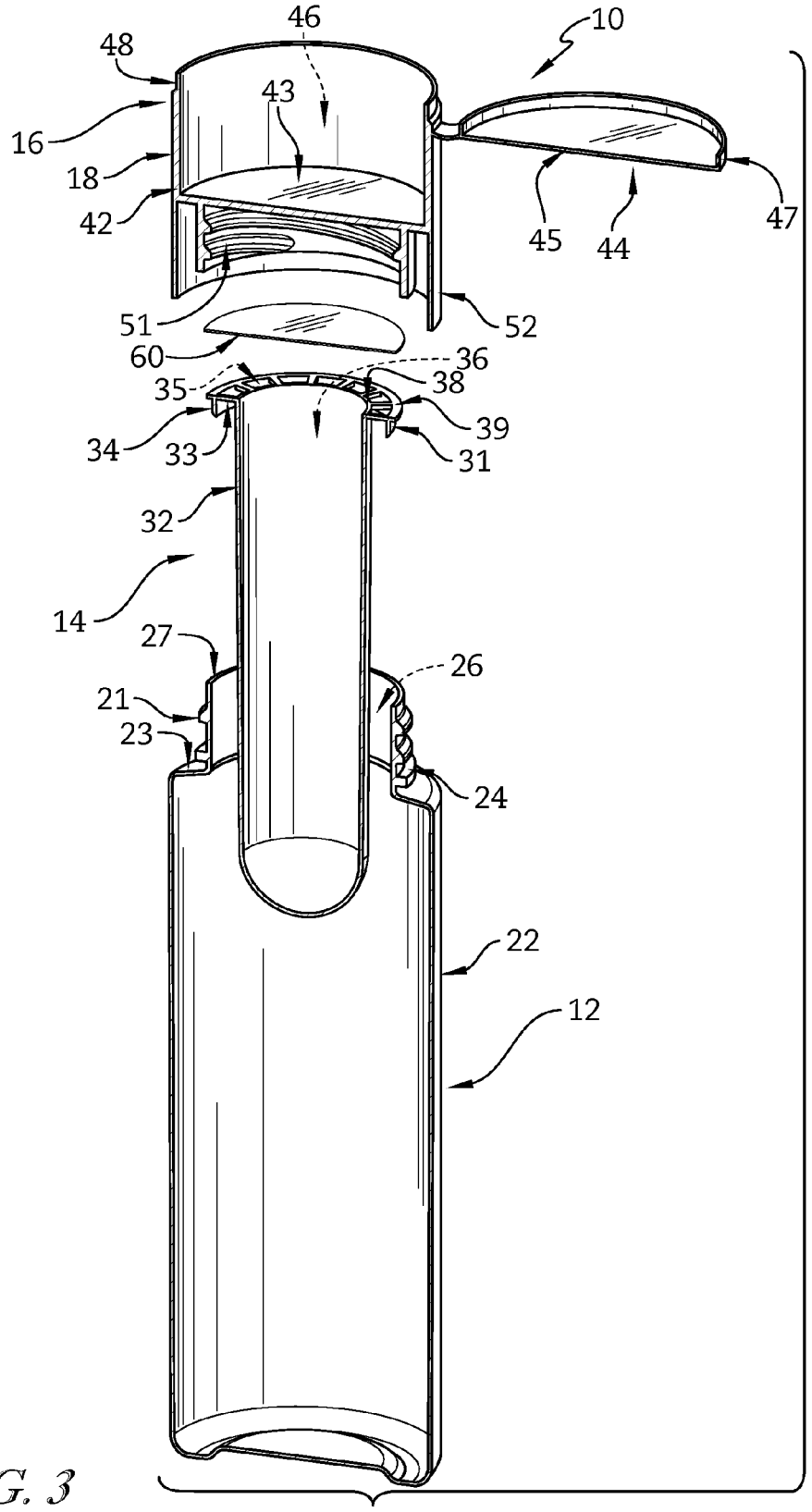
FIG. 3 is a cross-sectional exploded assembly view of the package of FIG. 2 showing that the package further includes a sealing disk positioned between the cap and the container and that the container includes a tube and a hanger coupled to the tube for connecting the container to a neck of the bottle and suggesting that the tube passes into the bottle through an opening of the neck.
Figure 5:
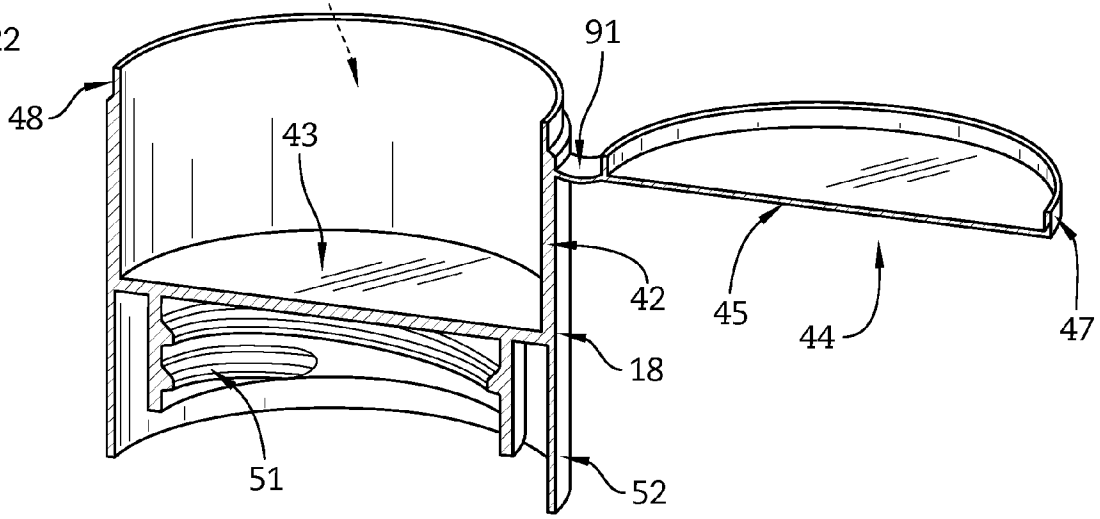
FIG. 5 is a cross-sectional view of the cap of FIG. 3 showing that cap includes a cylindrical skirt, a threaded connector for coupling the cap to the neck of the bottle, a base wall positioned to cover the container and opening of the neck when the cap is coupled to the bottle, an annular sidewall connected to the base wall to form an interior volume of the compartment, and a flip-top enclosure coupled to the annular side wall for covering an opening into the interior volume of the compartment.
Figure 4:
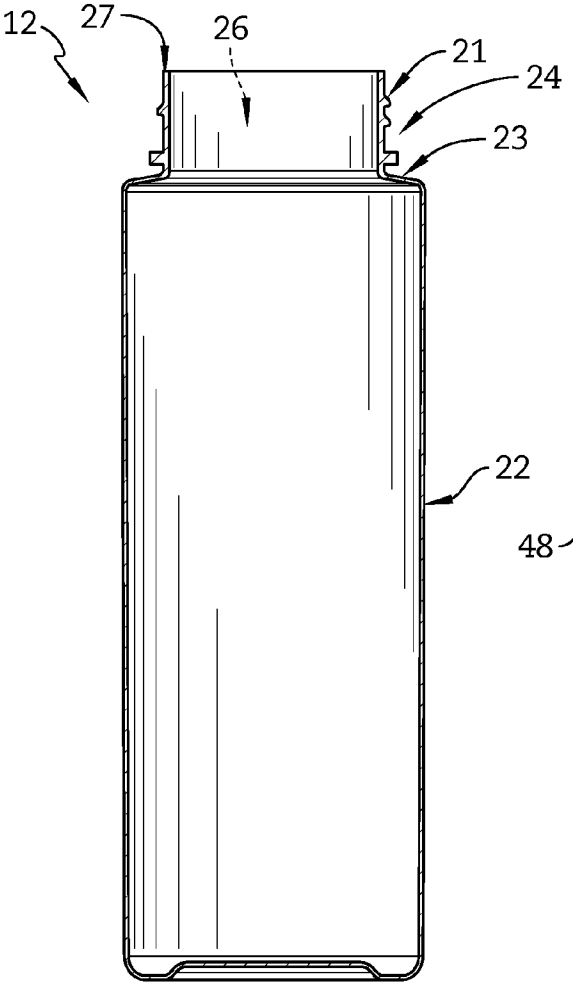
FIG. 4 is a cross-sectional view of the bottle of FIG. 3 showing that the neck of the bottle includes threads for engaging threads of the cap and suggesting that the cap can be threaded onto the neck to cover the container and enclose the interior volume of the bottle.

The package 10 holds multiple additive components in isolation prior to being combined as an additive mixture as suggested in FIG. 2. For example, the bottle 12 includes a body 22 defining an interior volume of the bottle 12 and a neck 24 coupled to the body 22 formed to include an opening 26 extending into the interior volume of the body 22. The bottle 12 may hold a first additive component within the interior volume of the body 22. The bottle 12 may be filled through the opening 26 of the neck 24. The first additive component may be a chemical compound or mixture in the form of a solid, liquid, solid suspended in liquid, or other alternative arrangement. The bottle 12 further includes neck threads 21 for coupling the cap 16 to the bottle 12 and a shoulder 23 for supporting the neck 24 and positioning the neck 24 radially inward of the body 22.

The container 14 includes a tube 32 for holding a second additive component and a hanger 34 for coupling the tube 32 to the neck 24 of the bottle 12 as suggested in FIG. 2. The hanger 34 supports the tube 32 such that the tube 32 hangs within the interior volume of the bottle 12. The tube 32 includes an opening 36 extending into an interior volume of the tube 32 allowing the tube 32 to be filled or emptied. The tube 32 holds the second additive component separate from the first additive component even when the tube 32 is suspended within the bottle 12. The second additive component may be a chemical compound or mixture in the form of a solid, liquid, solid suspended in liquid, or other alternative arrangement.

The cap 16 couples to the neck 24 of the bottle 12 to cover the openings 26, 36 of the bottle 12 and tube 32 as suggested in FIG. 2. The cap 16 blocks the contents of the tube 32 from mixing with the contents of the bottle 12. The cap 16 also blocks the contents of both the tube 32 and bottle 12 from moving to an exterior of the bottle 12 while the cap 16 is secured on the bottle 12. In the illustrative embodiment, an outer diameter of the cap 16 substantially matches an outer diameter of the body 22 of the bottle 12.

The cap 16 includes a compartment 18 for holding a third additive component separate from the first and second additive components, a threaded connector 51 for coupling the cap 16 to the neck 24 of the bottle 12, and a skirt 52 appended to the bottom of the compartment 18 surrounding the threaded connector 51 as suggested in FIG. 2. The third additive component may be a chemical compound or mixture in the form of a solid, liquid, solid suspended in liquid, or other alternative arrangement. The cap 16 may further include a child-proof device for blocking removal of the cap 16 from the bottle 12. For example, a rotation inhibitor may be appended to the skirt 52 and a blocker wall may be positioned on the neck 24 of the bottle 12 to block rotation of the cap 16 when the rotation inhibitor contacts the blocker wall. A user may squeeze the skirt 52 to laterally expand the skirt 52 to move the rotation inhibitor over the blocker wall to allow rotation of the cap 16.

The compartment 18 includes an annular side wall 42 and a base wall 43 coupled to one end of the annular side wall 42 to form an interior volume of the compartment 18 as shown in FIG. 2. An opening 46 extends into the interior volume of the compartment 18. A flip-top cover 44 is coupled to the annular side wall 42 by a living hinge 91. The living hinge 91 retains the flip-top cover 44 to the compartment 18 and allows the flip-top cover 44 to rotate relative to compartment 18. As such, the flip-top cover 44 may be moved between a closed position covering the opening 46 into the interior volume of the compartment 18 and an open position away from the opening 46. The flip-top cover 44 includes a cover wall 45 and a cover connector 47. The cover connector 47 engages a cover retainer 48 of the compartment 18 to retain the flip-top cover 44 in the closed position at the selection of a user. In an alternative embodiment, a removable cover may be used in place of flip-top cover 44 which may be completely removed from the compartment 18.

Figures 6, 7, 8:
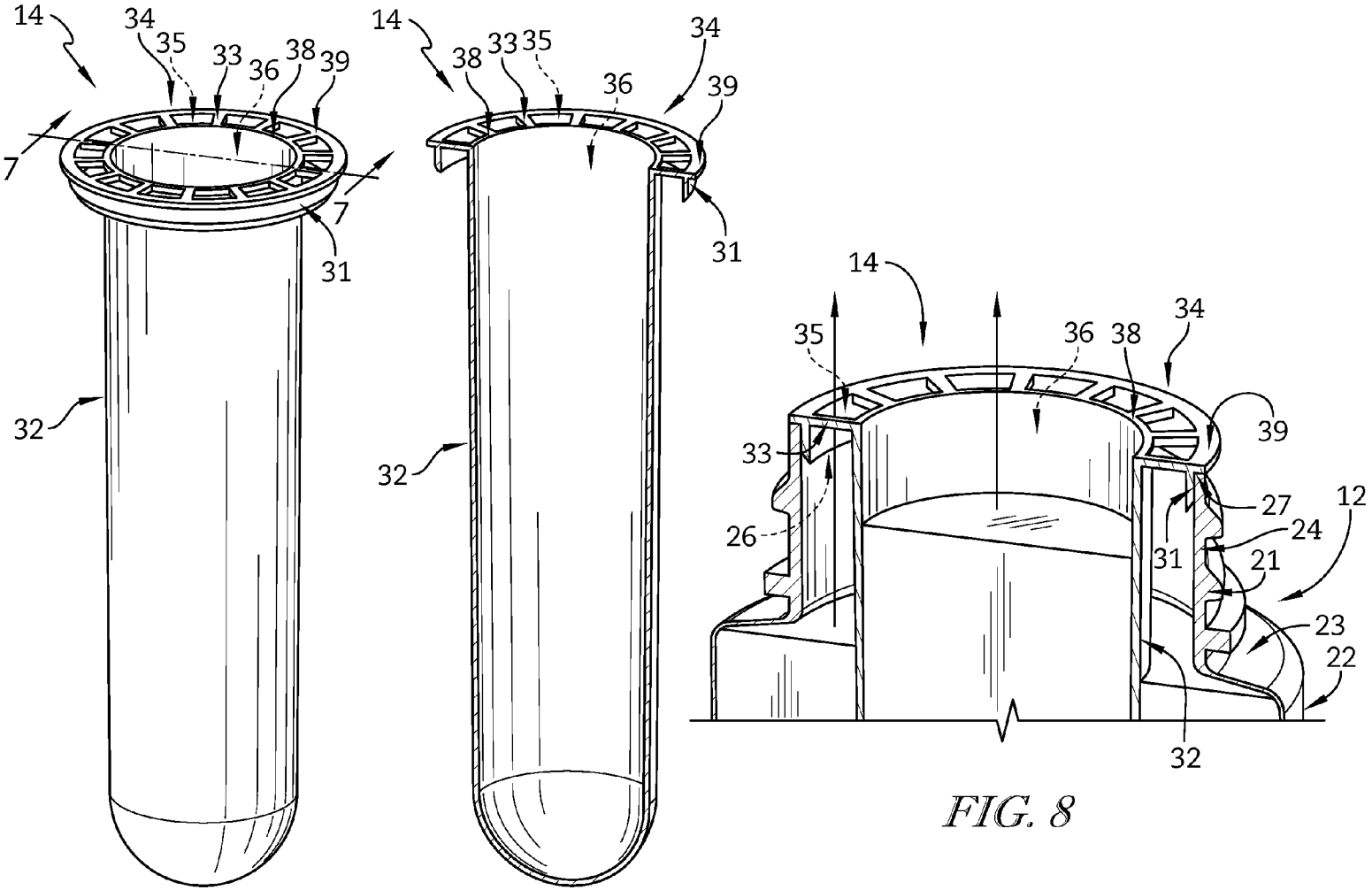
FIG. 6 is a perspective view of the container of FIG. 3 showing that the hanger is formed to include a plurality of pour-spout apertures to extend into the interior volume of the bottle when the container is attached to the bottle.
FIG. 7 is a partial cross-sectional view of the container of FIG. 6 showing that the hanger includes an annular clip and a tube holder coupled between the tube and annular clip and suggesting that the pour-spout apertures are formed through the tube holder.
FIG. 8 is partial cross-sectional view of the bottle and container of FIG. 3 showing that the annular clip attaches to the neck of the bottle and the tube holder supports the tube when the container is coupled to the bottle and suggesting that the first additive component within the bottle and the second additive component within the tube may be dispensed simultaneously.

The hanger 34 of the container 14 includes a tube holder 33 coupled to the tube 32, an annular flange 31 appended to the bottom of the tube holder 33 and spaced apart from the tube 32, and a plurality of pour-spout apertures 35 formed through the tube holder 33 and positioned between the tube 32 and annular clip 31 as shown in FIGS. 6 and 7. The neck 24 of the bottle 12 further includes a rim 27 defining the opening 26 as shown in FIG. 8. The hanger 34 also includes a stop wall 39 for engaging the rim 27 of the neck 24 to block the tube 32 from extending further into the bottle 12.

The bottle 12 and container 14 may be filled or emptied simultaneously as suggested in FIG. 8. For example, with the container 14 attached to the bottle 12 and the cap 16 removed, the first additive component passes through the pour-spout apertures 35, through the opening 26 of the neck 24, and into the body 22 of the bottle 12 while the second additive component passes through the opening 36 and into the tube 32. The reverse is also true where the first and second additive components are emptied from the bottle 12 and container 14, respectively.

Figure 10:
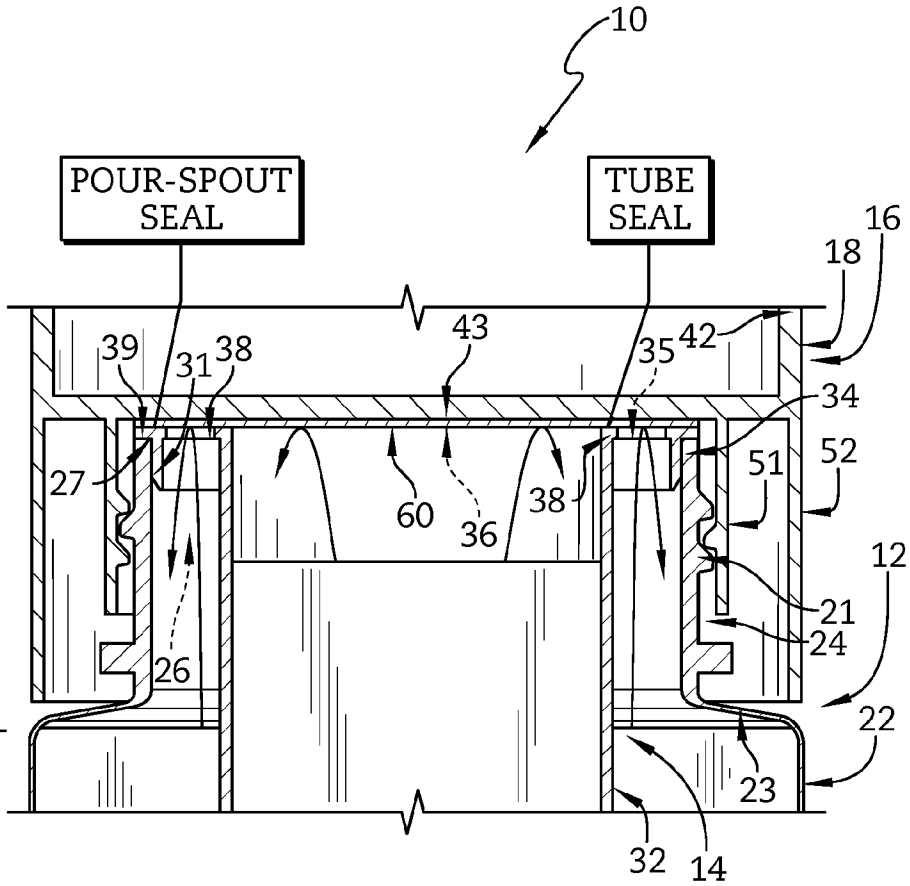
FIG. 10 is a partial cross-sectional view similar to FIG. 9 showing the cap coupled to the bottle over the container and the sealing disk positioned between the cap and container to form an aperture seal to prevent the contents of the bottle from passing through the pour-spout apertures to the exterior of the bottle and a tube seal to prevent the contents of the tube from passing out of the tube into the bottle or to an exterior of the bottle.
Figure 9:
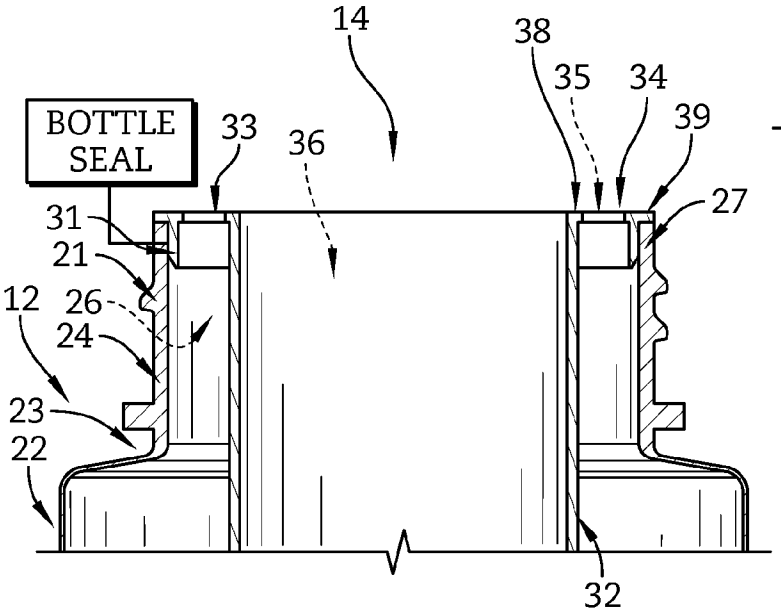
FIG. 9 is a partial cross-sectional view of the bottle and container of FIG. 3 showing the container coupled to the bottle to form a bottle seal along a rim of the neck to prevent the contents of the bottle from passing through the annular clip to an exterior of the bottle.

In one illustrative embodiment, the package 10 is assembled by coupling the container 14 to the bottle 12 and coupling the cap 16 to the bottle 12 over the container 14 as suggested in FIGS. 9 and 10. In one embodiment, the bottle 12 may be filled with the first additive component prior to inserting the tube 32 into the bottle 12 and coupling the container 14 to the neck 24 of the bottle 12. In an alternative embodiment, the bottle 12 may be filled with the first additive component after the container 14 has been coupled to the bottle 12.

During assembly, the container 14 is coupled to the neck 24 of the bottle 12 as suggested in FIG. 9. The annular clip 31 of the hanger 34 engages with an inside surface of the neck 24 to create a bottle seal. The bottle seal prevents the contents of the bottle 12 from moving to an exterior of the bottle 12 through the annular clip 31. In some embodiments, the bottle seal is a plug seal. In other embodiments, the stop wall 39 of the hanger 34 engages with the rim 27 of the neck 24 to form a seal.

The cap 16 is coupled to the neck 24 of the bottle 12 by engaging the threaded connector 51 with the neck threads 21 as suggested in FIG. 10. A sealing disk 60 may be positioned between the cap 16 and container 14 to assist in sealing the contents of the container 14 from the contents of the bottle 12 as detailed below. However, it should be noted that a sealing disk 60 is not required. For example, the base wall 43 of the cap 16 may function to seal the container 14 and bottle 12.

Coupling the cap 16 to the bottle 12 forces the sealing disk 60 against an upper surface of the stop wall 39 to form a pour-spout seal. The pour-spout seal prevents the contents of the bottle 12 from moving to an exterior of the bottle 12 through the pour-spout apertures 35. Connection of the cap 16 also forces the sealing disk 60 against a rim 38 of the tube 32 to form a tube seal. The tube seal prevents the contents of the tube 32 from entering the bottle 12 or moving to an exterior of the bottle 12. Thus, the interior volume of the bottle 12 and interior volume of the tube 32 are in fluid isolation of one another when the cap 16 is coupled to the bottle 12. The compartment 18 of the cap 16 is also in fluid isolation from the bottle 12 and container 14 while the cap 16 is coupled to the bottle 12.

A user may empty the contents of the package 10 simultaneously or in stages depending on the coolant additives being used. For example, the user may empty the contents of the compartment 18 prior to removal of the cap 16 from the bottle 12. The user may then remove the cap 16 and empty the contents of the bottle 12 and container 14. Alternatively, the user may remove the cap 16 and empty the contents of the compartment 18, bottle 12, and container 14 simultaneously.

Figure 11:
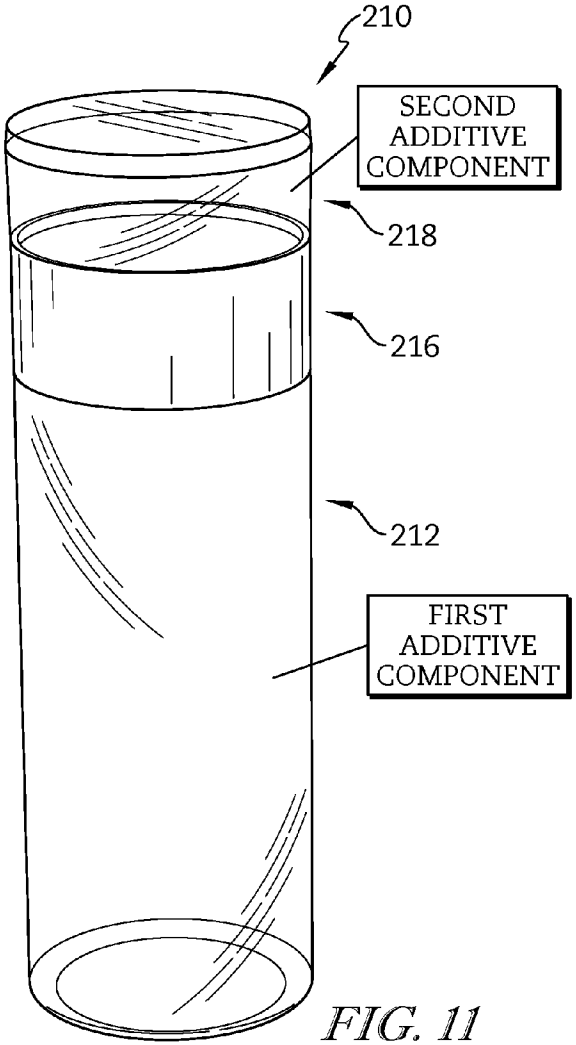
FIG. 11 is a perspective view of a second embodiment of a coolant additive package in accordance with the present disclosure showing the package includes a bottle for holding a first additive component, a transition cap for sealing the bottle, and a compartment for holding a second additive component separate from the first additive component and arranged to couple with the transition cap.

In another embodiment, a coolant additive package 210 includes a bottle 212, a transition cap 216, and a compartment 218 as suggested in FIG. 11. The bottle 212 is arranged to hold a first additive component and the compartment 218 is arranged to hold a second additive component separate from the first additive component. The transition cap 216 couples to the bottle 212 to seal the bottle 212 and to couple the compartment 218 to the bottle 212.

Figure 13:
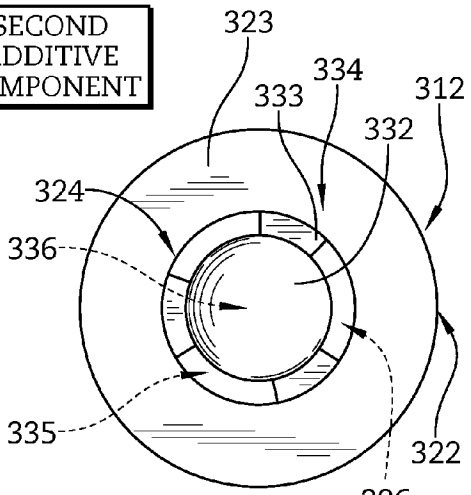
FIG. 13 is a top plan view of the package of FIG. 12 showing the container includes a plurality of pour-spout apertures and a tube holder and suggesting that the tube holder holds a tube of the container within the bottle and the pour-spout apertures allow the first additive component within the bottle and the second additive component within the tube to be dispensed simultaneously.
Figure 12:
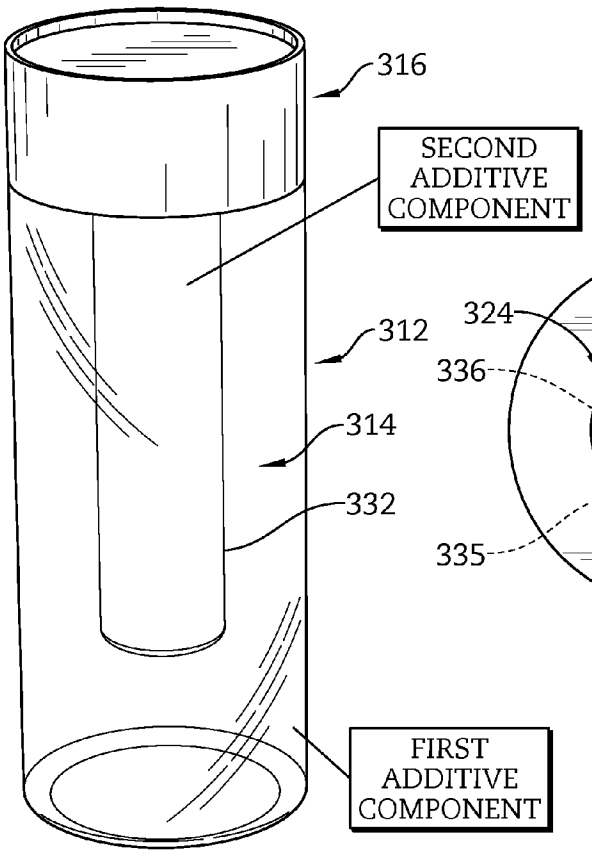
FIG. 12 is a perspective view of a third embodiment of a coolant additive package in accordance with the present disclosure showing the package includes a bottle for holding a first additive component, a container for holding a second additive component separate from the first, and a cap for sealing the bottle and container.

In another embodiment, a coolant additive package 310 includes a bottle 312, a container 314, and a cap 316 as suggested in FIGS. 12 and 13. The bottle 312 is arranged to hold a first additive component and the container 314 is arranged to hold a second additive component separate from the first additive component. The cap 316 couples to the bottle 312 to seal the bottle 312 and container 314. A tube 332 is suspended in the bottle 312 by a hanger 334 coupled to a neck 324 of the bottle 312.

The neck 324 is coupled to a body 322 of the bottle 312 by a shoulder 323. The tube 332 includes an opening 336 extending into an interior volume of the tube 332. The hanger 334 includes one or more pour-spout apertures 335 formed through a tube holder 333 to extend through an opening 326 of the neck 324 into an interior volume of the bottle 312. Thus, the tube 332 and bottle 312 may be filled or emptied simultaneously. However, it should be noted that the bottle 312 and tube 332 may be filled at different times and in different orders. The cap 316 may create seals between the bottle 312 and tube 314, similar to the cap 16, such that the contents of the tube 332 are in fluid isolation of the contents of the bottle 312.

Figure 14:
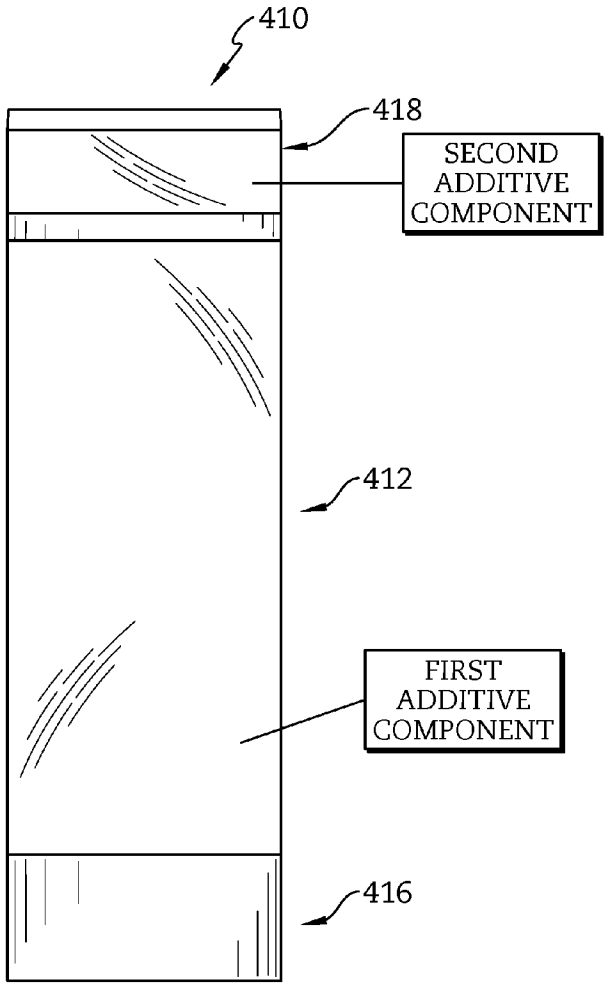
FIG. 14 is a perspective view of a fourth embodiment of a coolant additive package in accordance with the present disclosure showing the package includes a bottle for holding a first additive component, a cap for sealing the bottle, and a compartment for holding a second additive component separate from the first additive component and arranged to couple with the bottle.

In another embodiment, a coolant additive package 410 includes a bottle 412, a cap 416, and a compartment 418 as suggested in FIG. 14. The bottle 412 is arranged to hold a first additive component and the compartment 418 is arranged to hold a second additive component separate from the first additive component. The cap 416 couples to one end of the bottle 412 to seal the bottle 412. The compartment 418 is coupled to the bottle 412 at an opposite end from the cap 416.

Figure 15:
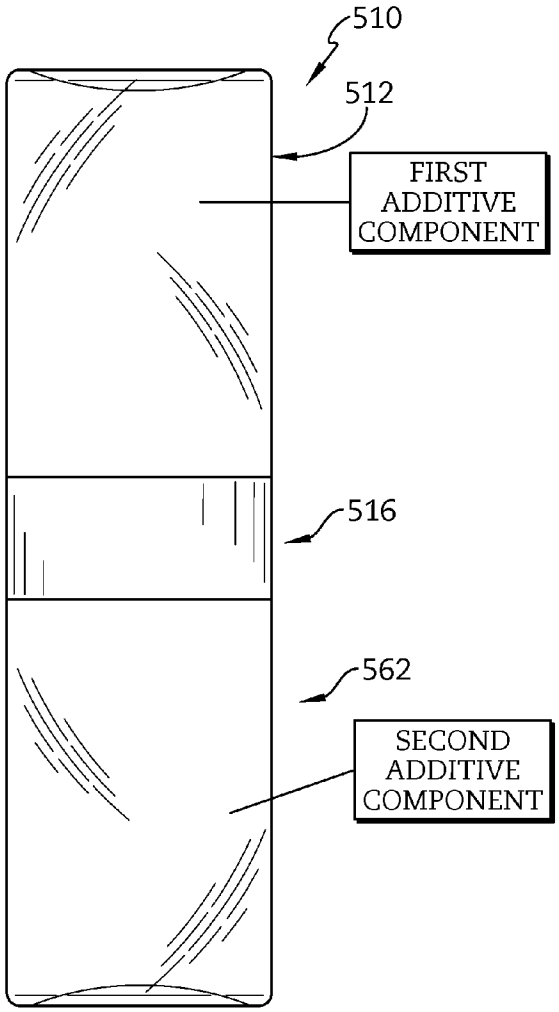
FIG. 15 is a perspective view of a fifth embodiment of a coolant additive package in accordance with the present disclosure showing the package includes a first bottle for holding a first additive component, a second bottle for holding a second additive component, and a transition cap for sealing the first and second bottles and to hold the first bottle to the second bottle.

In another embodiment, a coolant additive package 510 includes a first bottle 512, a transition cap 516, and a second bottle 562 as suggested in FIG. 15. In the illustrative embodiment, the first and second bottles 512, 562 are substantially similar in construction. However, the first bottle 512 may be larger or smaller than the second bottle 562. The first bottle 512 is arranged to hold a first additive component and the second bottle 562 is arranged to hold a second additive component separate from the first additive component. The transition cap 516 couples the first and second bottles 512, 562 together and seals the first and second bottles 512, 562.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A package comprising:

a bottle including a body defining an interior volume of the bottle and an opening extending into the interior volume of the bottle;

a container arranged to extend into the interior volume of the bottle, the container including a tube defining an interior volume of the container, an opening extending into the tube, and a hanger for coupling the container to the bottle to suspend the tube in the interior volume of the bottle; and a cap arranged to engage the bottle to cover the openings into the interior volumes of the bottle and the container, the cap including a compartment and a cover for closing an opening into an interior volume of the compartment;

wherein the interior volume of the compartment is defined by an annular side wall and a base wall coupled to the annular side wall, wherein the opening into the interior volume of the compartment is located on a first side of the base wall, and wherein an opposing second side of the base wall is configured to face towards the opening extending into the interior volume of the bottle when the cap is coupled with the bottle; and wherein the interior volume of the bottle is arranged to hold a first additive component, the interior volume of the container is arranged to hold a second additive component, the interior volume of the compartment is arranged to hold a third additive component, and the interior volumes of the bottle, container, and compartment are in fluid isolation relative to one another when the bottle, container, and cap are coupled together.

2. The package of claim 1, wherein the bottle further includes a neck coupled to the body by a shoulder to space the neck radially inward of an outer surface of the body, the neck defining the opening into the interior volume of the bottle.

3. The package of claim 2, wherein the tube is arranged to extend through the opening of the neck of the bottle and the hanger is arranged to couple with the neck to suspend the tube in the interior volume of the bottle.

4. The package of claim 3, wherein the hanger includes at least one pour-spout aperture formed therethrough to extend into the opening of the neck.

5. The package of claim 4, wherein the cap is arranged to couple to the neck of the bottle and engage the container to form seals to the opening of the tube and opening of the neck to provide fluid isolation between the interior volume of the bottle and interior volume of the container.

6. The package of claim 2, wherein an outer diameter of the cap substantially matches an outer diameter of the body of the bottle.

7. The package of claim 6, further comprising a hinge coupled between the compartment and the cover, the hinge positioned to allow rotation of the cover relative to the compartment and retain the cover on the compartment.

8. The package of claim 1, wherein the hanger includes at least one pour-spout aperture formed therethrough to extend into the opening of the bottle.

9. A method of assembling a package comprising:

inserting a container at least partially into an opening extending into an interior volume of a bottle, the container including a tube defining an interior volume of the container and formed to include an opening and a hanger coupled to the tube for supporting the tube, and the bottle including a body and a neck coupled to the body;

coupling the hanger of the container to the neck of the bottle; and coupling a cap to the bottle over the tube, the cap including a compartment and a cover for closing an opening into an interior volume of the compartment;

wherein the interior volume of the compartment is defined by an annular side wall and a base wall coupled to the annular side wall, wherein the opening into the interior volume of the compartment is located on a first side of the base wall, and wherein an opposing second side of the base wall is configured to face towards the opening extending into the interior volume of the bottle when the cap is coupled with the bottle.

10. The method of claim 9, wherein the interior volumes of the bottle, container, and compartment are in fluid isolation relative to one another when the bottle, container, and cap are coupled together.

11. The method of claim 10, further comprising filling the bottle with an additive component prior to inserting the container at least partially into the bottle.

12. The method of claim 10, further comprising filling the bottle with a first additive component and filling the tube with a second additive component simultaneously after coupling the container to the bottle.

13. The method of claim 10, further comprising filling the bottle with an additive component after inserting the container at least partially into the bottle.

14. The method of claim 10, further comprising filling the compartment with an additive component before coupling the cap to the bottle.

15. The method of claim 10, further comprising filling the compartment with an additive component after coupling the cap to the bottle.

* * * * *